US011852009B2

(12) United States Patent
Ross et al.

(10) Patent No.: US 11,852,009 B2
(45) **Date of Patent: *Dec. 26, 2023**

(54) DOWNHOLE MONITORING METHOD

(71) Applicant: METROL TECHNOLOGY LIMITED, Aberdeenshire (GB)

(72) Inventors: Shaun Compton Ross, Aberdeen (GB); Leslie David Jarvis, Aberdeen (GB)

(73) Assignee: METROL TECHNOLOGY LIMITED, Aberdeen (GB)

( * ) Notice: Subject to any disclaimer, the term of this patent is extended or adjusted under 35 U.S.C. 154(b) by 186 days.

This patent is subject to a terminal disclaimer.

(21) Appl. No.: 16/474,104

(22) PCT Filed: Dec. 19, 2017

(86) PCT No.: PCT/GB2017/053819
§ 371 (c)(1),
(2) Date: Jun. 27, 2019

(87) PCT Pub. No.: WO2018/122548
PCT Pub. Date: Jul. 5, 2018

(65) Prior Publication Data

US 2020/0123894 A1 Apr. 23, 2020

(30) Foreign Application Priority Data

Dec. 30, 2016 (GB) ..... 1622440

(51) Int. Cl.
*E21B 47/06* (2012.01)
*E21B 43/11* (2006.01)
(Continued)

(52) U.S. Cl.
CPC ..... *E21B 47/06* (2013.01); *E21B 43/11* (2013.01); *E21B 47/005* (2020.05); *E21B 47/12* (2013.01);
(Continued)

(58) Field of Classification Search
CPC ..... E21B 47/06; E21B 47/005; E21B 43/11; E21B 33/134
See application file for complete search history.

(56) References Cited

U.S. PATENT DOCUMENTS 2,591,807 A 4/1952 Greene
3,187,813 A 6/1965 Greene
(Continued)

FOREIGN PATENT DOCUMENTS

WO 2014117846 8/2014
WO 2015065387 5/2015
WO 2015130785 9/2015

OTHER PUBLICATIONS

International Search Report for PCT/GB2017/053819, dated Mar. 1, 2018.

(Continued)

*Primary Examiner* — Theodore N Yao
(74) *Attorney, Agent, or Firm* — WOMBLE BOND DICKINSON (US) LLP

(57) ABSTRACT

A method to test or monitor the integrity of a cement barrier, comprising providing an assembly therebelow including: a perforating device; a control mechanism to control the perforating device, a pressure sensor, a wireless communication device and a pressure sensor. The perforating device is activated to perforate casing below the barrier and a pressure test may be conducted. The creation of the perforation(s) below the barrier allows an assessment of the integrity of the barrier across its entire width, and especially its bond to the formation, rather than only a central portion of the barrier. Electromagnetic or acoustic wireless signals are used to retrieve data from below the barrier.

43 Claims, 5 Drawing Sheets

(51) Int. Cl.

| | |
|---|---|
| ***E21B 47/18*** | (2012.01) |
| ***E21B 47/13*** | (2012.01) |
| ***E21B 47/005*** | (2012.01) |
| ***E21B 47/12*** | (2012.01) |
| *E21B 33/12* | (2006.01) |

(52) U.S. Cl.
CPC ..... *E21B 47/13* (2020.05); *E21B 47/18* (2013.01); *E21B 33/1208* (2013.01)

(56) References Cited

U.S. PATENT DOCUMENTS

| | | | | |
|---|---|---|---|---|
| 5,372,198 | A * | 12/1994 | North | E21B 29/12 166/363 |
| 5,845,712 | A | 12/1998 | Griffith | |
| 6,095,245 | A * | 8/2000 | Mount | E21B 43/04 166/114 |
| 2004/0231840 | A1* | 11/2004 | Ratanasirigulchai | E21B 43/1195 166/259 |
| 2007/0044964 | A1* | 3/2007 | Grigar | E21B 43/08 166/278 |
| 2008/0110644 | A1 | 5/2008 | Howell et al. | |
| 2009/0261986 | A1* | 10/2009 | Mehta | E21B 47/125 340/853.6 |
| 2010/0319991 | A1* | 12/2010 | Brannigan | E21B 47/08 175/40 |
| 2013/0299165 | A1 | 11/2013 | Crow | |
| 2015/0034311 | A1* | 2/2015 | Tunget | E21B 47/005 166/250.14 |
| 2015/0096363 | A1* | 4/2015 | Hagen | E21B 33/134 73/152.51 |
| 2015/0252669 | A1 | 9/2015 | Fair et al. | |
| 2015/0330214 | A1* | 11/2015 | Duphorne | E21B 33/13 166/250.08 |
| 2018/0179886 | A1* | 6/2018 | Espe | E21B 47/002 |
| 2018/0252069 | A1* | 9/2018 | Abdollah | E21B 28/00 |
| 2019/0257169 | A1* | 8/2019 | Grimsbo | E21B 47/117 |
| 2019/0292905 | A1* | 9/2019 | Ross | E21B 47/12 |
| 2020/0080415 | A1* | 3/2020 | Behjat | E21B 33/14 |

OTHER PUBLICATIONS

UKIPO Combined Search and Examination Report for GB Application No. 1622440.4, dated Feb. 24, 2017.
UKIPO Examination Report for GB Application No. 1622440.4, dated Feb. 12, 2018.
UKIPO Examination Report for GB Application No. 1622440.4, dated Apr. 16, 2018.
EAPO Office Action for Corresponding Eurasian Application No. 201991596, dated Aug. 19, 2020.
Form 18 Search & Exam Report for Corresponding ARIPO Application No. AP/P/2019/011687, dated Nov. 17, 2021.
EAPO Office Action for Corresponding Eurasian Application No. 201991596, dated May 19, 2021.

* cited by examiner

DOWNHOLE MONITORING METHOD

CROSS REFERENCE TO RELATED APPLICATIONS

This application is a 35 U.S.C. 371 National Stage of International Application No. PCT/GB2017/053819, titled "A DOWNHOLE MONITORING METHOD", filed Dec. 19, 2017, which claims priority to GB Application No. 1622440.4, titled "A DOWNHOLE MONITORING METHOD", filed Dec. 30, 2016, all of which are incorporated by reference herein in their entirety.

BACKGROUND

This invention relates to a downhole monitoring method particularly but not exclusively during plug and abandonment or suspension operations.

A typical well construction includes a borehole having at least one tubular casing cemented in place against the geological formation.

When the well is no longer required, it is known to "plug and abandon" the well by plugging it with cement, or a cement alternative. To achieve this, a barrier may be added to control the well and a section of casing (and any adjacent cement) thereabove milled out. A section of the formation may also be cut away with a reamer. Fresh cement is then poured into this area to create a cement seal across the borehole, bonding with the geological formation.

In an alternative plugging procedure, the well may be perforated with a perforating gun, any old cement in the annular space between the casing and formation washed out, and new cement deployed across the borehole in the centre thereof, and extending out through the perforations into the annulus to bond with the formation.

In either case a cement plug or barrier is formed which, inter alia, is intended to prevent escape of fluids from the well after abandonment.

Similar methods may be used to suspend the well.

SUMMARY

Whilst generally satisfactory, the inventors of the present invention have recognised that it is difficult to assess the integrity of such a cement plug.

According to a first aspect of the present invention, there is provided a downhole monitoring method comprising:

setting at least one barrier in a cased borehole, the at least one barrier including a column of flowable sealing material, such as cement, having a height of at least 2 m, such that pressure and fluid communication are resisted across the borehole thus separating the borehole into a lower section below the at least one barrier and an upper section above the at least one barrier;

bonding said column of flowable sealing material to a portion of formation which defines a portion of the borehole;

at least a portion of the lower section being cased with casing, thus defining an annulus between the surrounding formation and the casing;

wherein there is provided an assembly in the lower section, including:

a perforating device;

a control mechanism to control the perforating device, and comprising a wireless communication device configured to receive a wireless control signal for activating the perforating device;

a pressure sensor;

at any time, sending the wireless control signal to the wireless communication device to activate the perforating device, the wireless control signal transmitted in at least one of the following forms: electromagnetic, acoustic, inductively coupled tubulars and coded pressure pulsing;

after the at least one barrier is set, activating the perforating device, in order to create at least one perforation through the casing;

after the perforating device has been activated:

(i) normally monitoring the pressure in the lower section below the at least one barrier using the pressure sensor; and, (ii) normally sending a wireless data signal including pressure data from below the at least one barrier to above the at least one barrier, using at least one of electromagnetic communication and acoustic communication.

Activation of the perforating device to create the perforation in the casing may create a path from an inside of the casing to the formation.

Creating at least one perforation between the borehole and the casing serves to open a fluid path in any pre-existing cement, the pre-existing cement being between the casing and the formation. In this way, any further leak path in the annulus between the formation and the casing, and especially any failure of the bond/seal of the at least one barrier with the surrounding formation can be detected using various pressure tests described herein.

After step (ii) the method may include (iii) assessing whether the lower section is, or to what extent, isolated.

Step (iii) may include assessing whether the lower section is, or to what extent, isolated from the upper section above the at least one barrier. Whilst setting a barrier in place in a well resists pressure and fluid communication, and is normally intended to seal or isolate across the barrier, it is normally required to assess if a seal has actually been made and the upper and lower sections are properly isolated.

The method may include monitoring the pressure over time in order to assess whether the lower section is, or to what extent, isolated. The time may be for example over 15 minutes (for example for a pressure test), more than 4 hours, or much longer, such as more than a day, more than a month, more than a year or more than five years (for example for monitoring the integrity of the barrier in the long term).

An earlier pressure test may also be conducted before the perforating device is activated to create the perforations.

The pressure sensor may be spaced away from the rest of the assembly. In one embodiment, the perforating device is spaced away from the combination of the wireless tool and pressure sensor, though various other combinations are feasible—the assembly does not need to be provided together. Nevertheless, the assembly may be referred to as an apparatus.

The method may include the step of monitoring the pressure above and below said at least one barrier, before, during or after the perforating.

The method may include clearing a section of the formation thus removing at least a portion of any pre-existing cement or other debris such as mud or filter cake, in order to at least partially clear the formation and so improve the bond with the flowable sealing material.

This may be done by one (or more) of milling, perforating, melting, acidising or dissolving or creating an explosion. The at least one barrier is then set, at least in part, in said section. The pre-existing cement is usually provided between the casing and the borehole, before the casing was removed/perforated/melted etc.

In particular, the step of clearing said section may include removing, such as milling out, a portion of the casing and at least a portion of any pre-existing cement in contact with the formation, in said section.

For certain other embodiments, the step of clearing said section includes an earlier perforating step of perforating a portion of casing in said section, and washing out at least a portion of any pre-existing cement in contact with the surrounding formation.

Optionally, an upper perforating device is provided, the upper perforating device provided in the upper section above the at least one barrier, and the method includes creating at least one perforation between the borehole and the casing above the at least one barrier.

The upper and lower sections may be adjacent upper and lower zones respectively.

The portion of the formation on which the column of flowable material is bonded is normally an impermeable portion i.e. no fluid path therethrough, and is often referred to as cap rock. The perforations may also be adjacent a similarly impermeable portion of the formation.

The method may be used for suspending and abandoning a section or adjacent zone of a borehole/well or the entire well/borehole.

The at least one barrier including a column of flowable sealing material (often cement) may also include other components, such as a sealing or non-sealing hanger, bridge plug or packer. A pressure sensor may be provided between the flowable sealing material portion and other components, such as a bridge plug, which can help verify in pressure tests described herein whether or not it is the flowable sealing material barrier which is containing pressure.

The flowable sealing material may include cement or a cement alternative or substitute. The flowable sealing material flows at least during deployment and may or may not harden/solidify.

References to setting a barrier should be construed as placing the barrier and not that the barrier hardens/solidifies.

References herein to cement include cement alternatives. A solidifying cement substitute may include epoxies and resins, or a non-solidifying cement substitute such as Sandaband™.

The flowable sealing material is hereinafter often referred to as cement.

A further option for the flowable sealing material/cement alternative/substitute for plug and abandon, is to melt (or more generally create an oxidation reaction) the tubulars and/or a portion of the surrounding formation. For example, thermite may be used for this purpose. The thermite may be a mixture of a metal powder fuel and an oxide, such as iron oxide.

Whilst the wireless signal could be sent before the barrier is set and the perforating device activated based on a time delay (so they are activated after the barrier has been set); normally the barrier is set before the wireless control signal is sent to the wireless communication device, such that the wireless control signal is sent from above the barrier to the wireless communication device below the barrier to activate the perforating device. Accordingly, for such embodiments, the wireless signal travels through/across/around the barrier.

The perforating device may be activated soon after, or more than a week or more than a month after the barrier has been set/the zone is suspended/abandoned. Indeed, the perforating device may be activated more than six months, more than a year or more than five years afterwards.

The barrier may suspend or abandon the lower section/zone, not necessarily the whole borehole/well, such that operations can continue in another section/zone, such as a well test or production of another zone. Alternatively the entire borehole/well may suspended or abandoned.

Suspending the zone is where the zone is put into a state where production to the surface does not occur, and where it is to be isolated by the barrier for at least one month, optionally more than three months or more than six months. Indeed, the borehole/well may be suspended for longer such as more than a year or more than five years.

Preferably therefore, the barrier is normally a permanent or semi-permanent barrier due to remain in place for at least one month, optionally more than three months or more than six months. Indeed, the barrier may be in place much longer term, such as more than a year or more than five years. Accordingly, no production to the surface would take place over such periods.

Abandoning the borehole/well is where it is not intended, or the option is not left open, to return to the borehole/well to produce fluids to the surface again. Therefore, the barrier is normally a permanent barrier due to remain in place indefinitely.

Dual Barrier

Two or more such barriers and optionally two or more such assemblies may be provided in the well. Therefore, the at least one barrier may be a primary barrier and at least one secondary barrier may include a column of flowable sealing material, may be set below the assembly, such that the at least one secondary barrier resists pressure and fluid communication across the borehole, thus isolating a section of the borehole between the primary and secondary barrier, from a section of the borehole below the secondary barrier.

For such embodiments, the secondary barrier would normally be set first.

The pressure sensor may be a primary pressure sensor and the borehole may include a secondary pressure sensor below the at least one secondary barrier.

For such embodiments, optionally, the assembly is a primary assembly the perforating device a primary perforating device, the control mechanism a primary control mechanism and the wireless communication device a primary wireless communication device and a secondary assembly may be provided below the at least one secondary barrier, the secondary assembly including:

- the secondary pressure sensor,
- a secondary perforating device;
- a secondary control mechanism to control the perforating device, and comprising a secondary wireless communication device configured to receive a wireless control signal for activating the perforating device;
- the method may include:
  - at any time, sending a wireless control signal to the secondary wireless communication device to activate the secondary perforating device, the wireless control signal transmitted in at least one of the following forms: electromagnetic, acoustic, inductively coupled tubulars and coded pressure pulsing;
  - after the at least one secondary barrier is set, activating the secondary perforating device, in order to create at least one perforation between the borehole and the casing;
  - monitoring the pressure in the section below the secondary barrier using the secondary pressure sensor; and
- sending a wireless data signal including pressure data from below the secondary barrier to above the secondary barrier, using at least one of electromagnetic communication, acoustic communication and inductively coupled tubulars.

The barrier may comprise or consist of a column of flowable sealing material (e.g. cement), such as a column having a height of at least 2 m or at least 10 m, at least 50 m, 200-500 m and perhaps up to 1000 m or even more. A short cement barrier may be preferred for zonal isolation, whereas longer cement barriers are typically used for borehole/well isolation.

The assembly may hang off the primary barrier.

The barrier is normally at least 100 m or 300 m below the surface of the borehole/well.

In addition to casing, for certain embodiments, especially those including acoustic communications, a tubular may extend from the primary and/or secondary barrier towards the surface of the borehole/well. For other embodiments, such as those using EM communication, this may not be necessary.

The monitoring step may be undertaken before and/or after the secondary barrier is set, optionally with a cement column in place above the primary barrier.

Components of the assembly/primary assembly described herein can therefore optionally be duplicated and included in the secondary assembly.

Reservoir Monitoring

The method may also include monitoring a reservoir after the at least one barrier is set by using a further assembly in the borehole below the at least one barrier. This normally monitors the reservoir through a communication path between the borehole and a permeable section of the formation and wireless communications as described herein may be used to relay signals and recover data.

The further assembly may comprise a further pressure sensor.

The method may include providing a further assembly adjacent a reservoir in the lower section, the further assembly including a further perforating device;

at any time, sending a wireless control signal to the or a further wireless communication device to activate the further perforating device, the wireless control signal transmitted in at least one of the following forms: electromagnetic, acoustic, inductively coupled tubulars and coded pressure pulsing;

after the at least one barrier is set, activating the further perforating device, in order to create at least one perforation between the well and a surrounding reservoir;

after the further perforating device has been activated:

(i) monitoring the pressure in the lower section below the at least one barrier using the or a further pressure sensor; and (ii) sending a wireless data signal including pressure data from below the at least one barrier to above the at least one barrier, using at least one of electromagnetic communication, acoustic communication and inductively coupled tubulars.

The further assembly may comprise a further control mechanism to control the further perforating device.

For such embodiments, the perforating device may be adjacent to an openhole section of a borehole to enhance connectivity particularly where the pores in the formation may be at least partially blocked by filter cake.

Container

The assembly or "apparatus" in certain embodiments of the present invention includes a container, and the method includes causing fluid movement through an aperture between an inside and an outside of the container. The direction of fluid movement is preferably from insider the container to outside the container though it can be utilised in the reverse direction.

A container may be provided in various parts of the borehole or well, normally below the primary (or secondary) barrier(s), optionally between the primary and secondary barriers.

The container can be especially useful for manipulating the pressure to pressure test the barrier. It can also be used to restore the pressure after a pressure drop.

The fluid movement between the inside and outside of the container can take place before, during and/or after the activation of the perforating device. Indeed, it may be delayed for more than an hour, more than a week, more than one month, optionally more than one year or more than five years after the perforating device has been activated. For example, it may be activated when work is being undertaken on a nearby borehole/well.

The apparatus may be elongate in shape. It may be in the form of a pipe. It is normally cylindrical in shape.

Whilst the size of the container can vary, depending on the nature of the borehole/well, typically the container may have a volume of at least 5 litres (l) or at least 50 l, optionally at least 100 l. The container may have a volume of at most 3000 l, normally at most 1500 l, optionally at most 500 l.

Thus the apparatus may comprise a pipe/tubular (or a sub in part of a pipe/tubular) housing a container and other components, or indeed, the container may be made up of tubulars, such as tubing or drill pipe joined together.

The aperture allowing fluid movement between an inside and an outside of the container may be a pre-existing aperture or "port" or may be created in situ, for example by a perforating device.

The aperture provides a cross-sectional area for pressure and fluid communication. Said area may be least 0.1 $cm^2$, optionally at least 0.25 $cm^2$, or at least 1 $cm^2$. The cross-sectional area may be at most 150 $cm^2$ or at most 25 $cm^2$, or at most 5 $cm^2$, optionally at most 2 $cm^2$.

In the first instance, a control device controls the aperture. As an alternative, the container comprises a housing for the perforating device, and the aperture is created by the activation of the (or a different) perforating device. Oftentimes, the perforating device includes at least one shaped charge.

There may be less than ten apertures, or less than five apertures.

Outside the container is generally the surrounding portion of the borehole/well. The surrounding portion of the borehole/well, is the portion of the borehole/well surrounding the apparatus, especially outside the aperture, immediately before the control device is moved in response to the control signal or the aperture created by the or a perforating device.

Entry or egress into or from the container is referred to as "fluid movement".

For certain embodiments, a container is positioned adjacent to, above or below perforations in order to clear perforations. Multiple containers may be used and provided together or separately in different parts of the borehole or well.

Control Device

The control device may comprise a mechanical valve assembly, a pump and/or a latch assembly. The control device normally responds to wireless signals via the, or a separate, wireless communication device. The control device may or may not be provided at the aperture. For embodiments with a control device and a pre-existing aperture, the control device may be moved in response to the control signal, at least 2 minutes before and/or at least 2 minutes after, any perforating device activation. It may be at least 10 minutes before and/or after any perforating device activation. Their independent control can elicit useful information between perforating device activating and the control device activating.

The control device may be adapted to close the aperture in a first position, and open the aperture in a second position. Thus, normally, in the first position the control device seals said inside of the container from said outside of the container, and normally, in the second position, the control device allows fluid entry to/from the container. Thus, in the second position, pressure and fluid communication may be allowed between said inside of the container and said outside of the container.

The control device may move again to the position in which it started, or to a further position, which may be a further open or further closed or partially open/closed position. This is normally in response to a further control signal being received. Optionally therefore the control device can move again to resist fluid movement between the container and the outside of the container. For example, flow rate can be stopped or started again or changed, and optionally this may be part-controlled in response to a parameter or time delay. Normally the control device in an open second position remains connected to the apparatus.

The control device may be closed before any pressure differential between the container and the outside of the container has balanced. The remaining pressure differential may optionally be utilised at a later time. Thus the procedure of moving the control device to allow or resist fluid movement can be repeated at a later time.

The control device may be at one end of the apparatus. However it may be in its central body. One or more may be provided at different positions.

The control mechanism may be configured to move the control device to selectively allow or resist fluid movement to/from at least a portion of the container when a certain condition is met, e.g. when a certain pressure is reached e.g. 2000 psi or after a time delay. Thus the control signal causing the response of moving the control device, may be conditional on certain parameters, and different control signals can be sent depending on suitable parameters for the particular borehole/well conditions.

Valve

The control device may comprise a mechanical valve assembly having a valve member adapted to move to selectively allow or resist fluid movement between at least a portion of the container and the outside of the container, via the aperture.

The valve member can be controlled directly or indirectly. In certain embodiments, the valve member is driven directly by the control mechanism though normally a separate, second, control mechanism is provided to control the valve member. It may be controlled electro-mechanically or electro-hydraulically via porting. In other embodiments the valve is controlled indirectly by, for example, movement of a piston causing the valve to move.

The mechanical valve assembly may comprise a solid valve member. The mechanical valve assembly normally has an inlet, a valve seat and a sealing mechanism. The seat and sealing mechanism may comprise a single component (e.g. pinch valve, or mechanically ruptured disc).

Piston, needle and sleeve valve assemblies are preferred.

The valve member may be actuated by at least one of a (i) motor & gear, (ii) spring, (iii) pressure differential, (iv) solenoid and (v) lead screw.

Differential Pressure Driven

A variety of different driving forces can cause fluid movement through the aperture such as a pressure differential between the inside and outside of the container, and/or a pump.

Before fluid movement, the pressure inside the container and outside the container may be different. This pressure difference is more than momentary, it is normally for at least one minute and usually longer.

Thus when an aperture is created, or a control device activated to allow communication through a pre-existing aperture, fluid moves from the higher pressure area to the lower pressure area.

For example, an overbalanced container (having a pressure higher than the outside of the container/surrounding portion of the borehole) can increase pressure in an isolated section of the borehole.

An underbalanced container (having a pressure less than the outside of the container/surrounding portion of the borehole) is an alternative. Normally at least 5 litres of fluid is drawn into the container optionally at least 50 l, or at least 100 l (other containers, such as overbalanced containers, can have a similar amount of fluid movement through the aperture). This can also be used for pressure testing or, when used to assist in reservoir monitoring, can remediate formation damage, that is at least partially unblock any blocked portions and/or clear portions of the borehole and/or surrounding formation; often sufficient to improve pressure connectivity between the borehole and formation.

The container normally comprises gas for example, at least 85 vol % gas, such as nitrogen, carbon dioxide, or air. In one embodiment, fluid can be sealed in at least a portion (for example more than 50 vol %) of the container at atmospheric pressure before being deployed, and then the apparatus deployed in the borehole (which has a higher downhole pressure). Thus, the pressure in said portion of the container which has a pressure less than the outside of the container may be, before fluid movement, in the range of 14 to 25 psi, that is normal atmospheric pressure which has sometimes increased with the higher temperatures in the borehole. Alternatively, the container may be effectively evacuated, that is at a pressure of less than 14 psi, optionally less than 10 psi.

The pressure difference between the inside of the container with a reduced pressure and said outside of the container before fluid movement is allowed may be at least 100 psi, or at least 500 psi, preferably at least 1000 psi.

Pump Driven

Alternatively or additionally, the control device may comprise an electrical pump to cause fluid movement through the aperture between the inside and outside of the container. The pump may be provided at the aperture. Optionally the pump is configured to pump fluid from outside the container to inside the container. Alternatively, the pump is operated to pump fluid from within the container to the surrounding portion of the borehole. Often this is at least one litre or more than five litres of fluid which has been added to the container at the surface before the apparatus is run into the borehole. This fluid may be used to create a pressure change for a pressure test of the at least one barrier or to treat the borehole/well/reservoir.

The electrical pump is preferably a positive displacement pump such as a piston pump, gear type pump, screw pump, diaphragm, lobe pump; especially a piston or gear pump. Alternatively the pump may be a velocity pump such as a centrifugal pump.

The pump may be operable to pumps fluids at a rate of 0.01 cc/s to 20 cc/s.

The pump operation or rate can be controlled in response to a further control signal being received by the or a separate wireless communication device (or this may be an instruction in the original signal).

Other Control Devices

The control device may comprise a latch assembly which in turn controls a floating piston—it can hold the floating piston in place against action of other forces (e.g. borehole pressure) and is released/moved in response to an instruction from a controller to allow fluid movement through the aperture.

The aperture may include a non-return valve which can resist fluid movement therethrough.

Choke

The apparatus may comprise a choke.

The choke may be integrated with the control device or it may be in a flowpath comprising the aperture and the control device.

Said cross-sectional area may comprise a filter.

The valve member may function as the choke, optionally an adjustable choke which can be varied in situ or it may be a fixed choke.

Thus the size of the cross-sectional area for fluid movement may be small enough, for example 0.1-0.25 $cm^2$, which effectively chokes the fluid movement.

Floating Piston

A floating piston may be provided in the container, such as to separate one fluid from another. For example, on one side of a floating piston, fluid to be released can be provided, and on another side, a gas at a higher pressure than the surrounding borehole can be provided to drive the fluid out when a control device allows pressure and fluid communication between the container and the surrounding borehole.

Certain embodiments have the container and said floating piston, without additional chambers. The pressure in the container can charged and then held until the surrounding portion of the borehole/well is at a different pressure. For certain other embodiments, the container may include two sections separated by the control device, one being a fluid chamber and the second chamber being a dump chamber or a drive chamber. Where there is a pressure difference between the inside and outside of the container, the second chamber is normally the portion of the container having such a pressure difference.

The control device can control fluid movement between the fluid chamber and the second chamber.

The floating piston can further separate two sections in the fluid chamber, one section in fluid communication with the aperture and another section on an opposite side of the floating piston, in communication with the second chamber.

Thus one side of the floating piston may be exposed to the borehole pressure via the aperture. A fluid, such as oil, may be provided in the fluid chamber on the second chamber side of the floating piston.

For embodiments with a second chamber, a variety of embodiments can be provided. The second chamber may be a dump chamber with a pressure less than that of the surrounding portion of the borehole, whilst the control device comprises a valve, thus indirectly allowing or resisting fluids to be drawn into the fluid chamber section of the container.

Alternatively, the second chamber may be a drive chamber having a pressure higher than that of the surrounding portion of the borehole. In which case, the control device optionally comprising a valve can allow or resist fluids to be expelled from the fluid chamber section of the container.

In either case, for these embodiments, since the control device is between the fluid chamber and the second chamber, it indirectly controls fluid movement through the aperture in the fluid chamber.

Thus in response to the control signal the control device can allow fluid movement between the container (fluid chamber section) and an outside of the container, for example the borehole, to draw in or expel fluids therefrom.

A non-return valve may be provided in the aperture.

The second chamber may have at least 90% of the volume of that of the fluid chamber although for certain embodiments, the second chamber has a volume greater than the volume of the fluid chamber to avoid or mitigate pressure build-up within the second chamber and hence achieve a more uniform flow rate into the fluid chamber.

Normally the floating piston has a dynamic seal against an inside of the container.

Secondary Containers

In addition to the container (sometimes referred to below as a 'primary container') there may be one or more secondary containers, optionally each with respective control devices controlling fluid communication between the inside of the respective secondary container and the outside of that container. This may be, for example, a surrounding portion of the borehole/well, or another portion of the apparatus or the formation.

Thus there may be one, two, three or more than three secondary containers. The further control devices for the secondary containers may or may not move in response to a control signal, but may instead respond based on a parameter or time delay. Each control device for the respective secondary container can be independently operable. A common communication device may be used for sending a control signal to a plurality of control devices.

The containers may have a different internal pressure compared to the pressure outside of the container such as the surrounding portion of the borehole or the formation. If less than the outside of the container, as described more generally herein, they are referred to as 'underbalanced' and when more than the outside of the container they are referred to as 'overbalanced'.

Thus, a plurality of primary and/or secondary containers or apparatus may be provided each having different functions, one or more containers may be underbalanced, one or more containers overbalanced, or one or more containers controlled by a pump. Underbalanced, overbalanced and/or pump controlled secondary container(s) and associated apertures and control devices may be provided, the secondary container(s) each preferably having a volume of at least five litres and, in use, having a pump and/or a pressure lower/higher than the outside of the container normally for at least one minute, before the control device is activated optionally in response to the control signal. Fluids surrounding the secondary container can thus be drawn in (for underbalanced containers), optionally quickly, or fluids expelled (for overbalanced containers).

This can be useful, for example, to partially clear a filter cake using an underbalanced container, before deploying an acid treatment onto the perforations, particularly when combined with the reservoir monitoring, using the container controlled by a pump.

Alternatively, for a short interval manipulation, a skin barrier could be removed from the interval by acid deployed from an overbalanced container and then the apparatus with an underbalanced container used to draw fluid from the interval.

Fluid from a first chamber within the container can go into another to mix before being released/expelled.

The secondary aperture may include a non-return valve which can resist fluid release from the container.

Other Apparatus Options

In addition to the wireless signal, the apparatus may include pre-programmed sequences of actions, e.g. a valve opening and re-closing, or a change in valve member position; based on parameters e.g. time, pressure detected or not detected or detection of particular fluid or gas. For example, under certain conditions, the apparatus will perform certain steps sequentially—each subsequent step following automatically. This can be beneficial where a delay to wait for a signal to follow on could mitigate the usefulness of the operation.

Normally the aperture is provided on a side face of the apparatus although certain embodiments can have the aperture provided in an end face.

There may be more than one apparatus.

Reduced Well Pressure

Before setting the barrier, lighter fluids may be circulated in the borehole for example as part of a flow test, or for other reasons. This reduces the pressure in the borehole because of the reduced hydrostatic head of the lighter fluids. For certain embodiments, the barrier may be set whilst the pressure in the borehole is reduced in this way to a pressure lower than the reservoir pressure. Therefore the borehole may be underbalanced with respect to the reservoir at the time of perforating.

An advantage of such embodiments is that when the perforating device is activated the reduced pressure draws more debris away from the perforation(s) in order to enhance the connectivity between the borehole and the surrounding reservoir.

Often heavy fluid is provided in the borehole to help control it.

This heavy fluid can lead to poor pressure connectivity through perforations between reservoir and borehole. Embodiments of the present invention provide the barrier, thus enabling the reservoir to be perforated in a zone without such heavy fluid, thus avoiding contact between the heavy fluid and the perforations.

Sensors

The apparatus may include sensors for fluid analysis including optical fluid analysis, density, water cut and those to determine Gas:Oil Ratio (GOR).

Any other sensors are preferably provided below the barrier and data recovered as described herein for the pressure sensor. Preferably a temperature sensor is also provided. A variety of other sensors may be provided, including acceleration, vibration, torque, movement, motion, radiation, noise, magnetism, corrosion; chemical or radioactive tracer detection; fluid identification such as hydrate, wax and sand production; and fluid properties such as (but not limited to) flow, density, water cut, for example by capacitance and conductivity, pH and viscosity. Furthermore the sensors may be adapted to induce the signal or parameter detected by the incorporation of suitable transmitters and mechanisms. The sensors may also sense the status of other parts of the apparatus or other equipment within the borehole, for example control device status, such as valve member position.

An array of discrete temperature sensors or a distributed temperature sensor can be provided (for example run in) with the apparatus. Thus they may be below the barrier, or above the barrier or even outside the casing. Preferably therefore it is below the barrier.

These temperature sensors may be contained in a small diameter (e.g. ¼") tubing line and may be connected to a transmitter or transceiver. If required any number of lines containing further arrays of temperature sensors can be provided. This array of temperature sensors and the combined system may be configured to be spaced out so the array of temperature sensors contained within the tubing line may be aligned across the formation, for example the perforations; either for example generally parallel to the borehole, or in a helix shape.

The array of discrete temperature sensors may be part of the apparatus or separate from it.

The temperature sensors may be electronic sensors or may be a fibre optic cable.

Therefore in this situation the additional temperature sensor array could provide data from the perforation interval(s) and indicate if, for example, perforations are blocked/restricted. The array of temperature sensors in the tubing line can also provide a clear indication of fluid flow, particularly when the apparatus is activated. Thus for example, more information can be gained on the response of the perforations—an upper area of perforations may have been opened and another area remain blocked and this can be deduced by the local temperature along the array of the temperature sensors.

Data may be recovered from the pressure sensor(s), before, during and/or after the perforating device is activated, and before during or after the fluid movement is caused between an inside and an outside of the container.

Recovering data means retrieving the data to the surface. The data recovered may be real-time/current data and/or historical data. Data is preferably sent by acoustic and/or electromagnetic signals.

Data may be recovered by a variety of methods. For example it may be transmitted wirelessly in real time or at a later time, optionally in response to an instruction to transmit.

Memory

The apparatus especially the sensor(s), may comprise a memory device which can store data for recovery at a later time. The memory device may also, in certain circumstances, be retrieved and data recovered after retrieval.

The memory device may be part of sensor(s). Where separate, the memory device and sensors may be connected together by any suitable means, optionally wirelessly or physically coupled together by a wire. Inductive coupling is also an option. Short range wireless coupling may be facilitated by EM communication in the VLF range.

The apparatus may be configured to monitor the pressure or other parameters below the barrier for periods of time longer than one week, one month, one year or more than five years.

The memory device may be configured to store information for at least one minute, optionally at least one hour, more optionally at least one week, preferably at least one month, more preferably at least one year or more than five years.

Signals

The wireless control signal is transmitted in at least one of the following forms: electromagnetic, acoustic, inductively coupled tubulars and coded pressure pulsing and references herein to "wireless" relate to said forms, unless where stated otherwise.

The signals may be data or command signals and need not be in the same wireless form. Accordingly, the options set out herein for different types of wireless signals are independently applicable to data and command signals. The control signals can control downhole devices including sensors. Data from sensors may be transmitted in response to a control signal. Moreover data acquisition and/or transmission parameters, such as acquisition and/or transmission rate or resolution, may be varied using suitable control signals.

Coded Pressure Pulses

Coded pressure pulses may be used to activate the perforating device. A firing head of the perforating device may be above the barrier.

Pressure pulses include methods of communicating from/to within the well/borehole, from/to at least one of a further location within the well/borehole, and the surface of the well/borehole, using positive and/or negative pressure changes, and/or flow rate changes of a fluid in a tubular and/or annular space.

Coded pressure pulses are such pressure pulses where a modulation scheme has been used to encode commands within the pressure or flow rate variations and a transducer is used within the well/borehole to detect and/or generate the variations, and/or an electronic system is used within the well/borehole to encode and/or decode commands.

Therefore, pressure pulses used with an in-well/borehole electronic interface are herein defined as coded pressure pulses. An advantage of coded pressure pulses, as defined herein, is that they can be sent to electronic interfaces and may provide greater data rate and/or bandwidth than pressure pulses sent to mechanical interfaces.

Where coded pressure pulses are used to transmit control signals, various modulation schemes may be used to encode control signals such as a pressure change or rate of pressure change, on/off keyed (OOK), pulse position modulation (PPM), pulse width modulation (PWM), frequency shift keying (FSK), pressure shift keying (PSK), amplitude shift keying (ASK), combinations of modulation schemes may also be used, for example, OOK-PPM-PWM. Data rates for coded pressure modulation schemes are generally low, typically less than 10 bps, and may be less than 0.1 bps.

Coded pressure pulses can be induced in static or flowing fluids and may be detected by directly or indirectly measuring changes in pressure and/or flow rate. Fluids include liquids, gasses and multiphase fluids, and may be static control fluids, and/or fluids being produced from or injected in to the borehole.

Signals—General

Preferably the wireless signals are such that they are capable of passing through a barrier, such as a plug, when fixed in place. Preferably therefore the wireless signals are transmitted in at least one of the following forms: electromagnetic, acoustic, and inductively coupled tubulars.

EM/Acoustic and coded pressure pulsing use the well, borehole or formation as the medium of transmission. The EM/acoustic or pressure signal may be sent from the borehole, or from the surface. An EM/acoustic signal can travel through the barrier, although for certain embodiments, it may travel indirectly, for example around the barrier.

Electromagnetic and acoustic signals are especially preferred—they can transmit through/past an annular barrier without special inductively coupled tubulars infrastructure, and for data transmission, the amount of information that can be transmitted is normally higher compared to coded pressure pulsing, especially data from the borehole.

Therefore, the wireless communication device may comprise an acoustic communication device and the wireless control signal comprises an acoustic control signal and/or the wireless communication device may comprise an electromagnetic communication device and the wireless control signal comprises an electromagnetic control signal.

Similarly the transmitters and receivers used correspond with the type of wireless signals used. For example an acoustic transmitter and receiver are used if acoustic signals are used.

Where inductively coupled tubulars are used, there are normally at least ten, usually many more, individual lengths of inductively coupled tubular which are joined together in use, to form a string of inductively coupled tubulars. They have an integral wire and may be formed tubulars such as tubing, drill pipe or casing. At each connection between adjacent lengths there is an inductive coupling.

The inductively coupled tubulars that may be used can be provided by N O V under the brand Intellipipe®.

Thus, the EM/acoustic or pressure wireless signals can be conveyed a relatively long distance as wireless signals, sent for at least 200 m, optionally more than 400 m or longer which is a clear benefit over other short range signals. Embodiments including inductively coupled tubulars provide this advantage/effect by the combination of the integral wire and the inductive couplings. The distance travelled may be much longer, depending on the length of the borehole.

The control signal, and optionally other signals, may be sent in wireless form from above the barrier to below the barrier. Likewise signals may be sent from below the barrier to above the barrier in wireless form.

Data and commands within the signal may be relayed or transmitted by other means. Thus the wireless signals could be converted to other types of wireless or wired signals, and optionally relayed, by the same or by other means, such as hydraulic, electrical and fibre optic lines. In one embodiment, the signals may be transmitted through a cable for a first distance, such as over 400 m, and then transmitted via acoustic or EM communications for a smaller distance, such as 200 m. In another embodiment they are transmitted for 500 m using coded pressure pulsing and then 1000 m using a hydraulic line.

Thus whilst non-wireless means may be used to transmit the signal in addition to the wireless means, preferred configurations preferentially use wireless communication. Thus, whilst the distance travelled by the signal is dependent on the depth of the borehole, often the wireless signal, including relays but not including any non-wireless transmission, travel for more than 1000 m or more than 2000 m. Preferred embodiments also have signals transferred by wireless signals (including relays but not including non-wireless means) at least half the distance from the surface of the borehole to the apparatus.

Different wireless signals may be used in the same borehole for communications going from the borehole towards the surface, and for communications going from the surface into the borehole.

Thus, the wireless signal may be sent to the communication device, directly or indirectly, for example making use of in-borehole relays above and/or below the barrier.

The wireless signal may be sent from the surface or from a wireline/coiled tubing (or tractor) run probe at any point in the borehole above the barrier. For certain embodiments, the probe may be positioned relatively close to the barrier for example less than 30 m therefrom, or less than 15 m.

Acoustic

Acoustic signals and communication may include transmission through vibration of the structure of the borehole including tubulars, casing, liner, drill pipe, drill collars, tubing, coil tubing, sucker rod, downhole tools; transmission via fluid (including through gas), including transmission through fluids in uncased sections of the borehole, within tubulars, and within annular spaces; transmission through static or flowing fluids; mechanical transmission through wireline, slickline or coiled rod; transmission through the earth; transmission through wellhead equipment. Communication through the structure and/or through the fluid are preferred.

Acoustic transmission may be at sub-sonic (<20 Hz), sonic (20 Hz-20 kHz), and ultrasonic frequencies (20 kHz-2 MHz). Preferably the acoustic transmission is sonic (20 Hz-20 khz).

The acoustic signals and communications may include Frequency Shift Keying (FSK) and/or Phase Shift Keying (PSK) modulation methods, and/or more advanced derivatives of these methods, such as Quadrature Phase Shift Keying (QPSK) or Quadrature Amplitude Modulation (QAM), and preferably incorporating Spread Spectrum Techniques. Typically they are adapted to automatically tune acoustic signalling frequencies and methods to suit borehole conditions.

The acoustic signals and communications may be unidirectional or bi-directional. Piezoelectric, moving coil transducer or magnetostrictive transducers may be used to send and/or receive the signal.

EM

Electromagnetic (EM) (sometimes referred to as Quasi-Static (QS)) wireless communication is normally in the frequency bands of: (selected based on propagation characteristics)

sub-ELF (extremely low frequency)<3 Hz (normally above 0.01 Hz);

ELF 3 Hz to 30 Hz;

SLF (super low frequency) 30 Hz to 300 Hz;

ULF (ultra low frequency) 300 Hz to 3 kHz; and,

VLF (very low frequency) 3 kHz to 30 kHz.

An exception to the above frequencies is EM communication using the pipe as a wave guide, particularly, but not exclusively when the pipe is gas filled, in which case frequencies from 30 kHz to 30 GHz may typically be used dependent on the pipe size, the fluid in the pipe, and the range of communication. The fluid in the pipe is preferably non-conductive. U.S. Pat. No. 5,831,549 describes a telemetry system involving gigahertz transmission in a gas filled tubular waveguide.

Sub-ELF and/or ELF are preferred for communications from a borehole to the surface (e.g. over a distance of above 100 m). For more local communications, for example less than 10 m, VLF is preferred. The nomenclature used for these ranges is defined by the International Telecommunication Union (ITU).

EM communications may include transmitting communication by one or more of the following: imposing a modulated current on an elongate member and using the earth as return; transmitting current in one tubular and providing a return path in a second tubular; use of a second borehole as part of a current path; near-field or far-field transmission; creating a current loop within a portion of the borehole metalwork in order to create a potential difference between the metalwork and earth; use of spaced contacts to create an electric dipole transmitter; use of a toroidal transformer to impose current in the borehole metalwork; use of an insulating sub; a coil antenna to create a modulated time varying magnetic field for local or through formation transmission; transmission within the borehole casing; use of the elongate member and earth as a coaxial transmission line; use of a tubular as a wave guide; transmission outwith the borehole casing.

Especially useful is imposing a modulated current on an elongate member and using the earth as return; creating a current loop within a portion of the borehole metalwork in order to create a potential difference between the metalwork and earth; use of spaced contacts to create an electric dipole transmitter; and use of a toroidal transformer to impose current in the borehole metalwork.

To control and direct current advantageously, a number of different techniques may be used. For example one or more of: use of an insulating coating or spacers on borehole tubulars; selection of borehole control fluids or cements within or outwith tubulars to electrically conduct with or insulate tubulars; use of a toroid of high magnetic permeability to create inductance and hence an impedance; use of an insulated wire, cable or insulated elongate conductor for part of the transmission path or antenna; use of a tubular as a circular waveguide, using SHF (3 GHz to 30 GHz) and UHF (300 MHz to 3 GHz) frequency bands.

Suitable means for receiving the transmitted signal are also provided, these may include detection of a current flow; detection of a potential difference; use of a dipole antenna; use of a coil antenna; use of a toroidal transformer; use of a Hall effect or similar magnetic field detector; use of sections of the borehole metalwork as part of a dipole antenna. Where the phrase "elongate member" is used, for the purposes of EM transmission, this could also mean any elongate electrical conductor including: liner; casing; tubing or tubular; coil tubing; sucker rod; wireline; drill pipe; slickline or coiled rod.

A means to communicate signals within a borehole with electrically conductive casing is disclosed in U.S. Pat. No. 5,394,141 by Soulier and U.S. Pat. No. 5,576,703 by MacLeod et al both of which are incorporated herein by reference in their entirety. A transmitter comprising oscillator and power amplifier is connected to spaced contacts at a first location inside the finite resistivity casing to form an electric dipole due to the potential difference created by the current flowing between the contacts as a primary load for the power amplifier. This potential difference creates an electric field external to the dipole which can be detected by either a second pair of spaced contacts and amplifier at a second location due to resulting current flow in the casing or alternatively at the surface between a wellhead and an earth reference electrode.

Relay

A relay comprises a transceiver (or receiver) which can receive a signal, and an amplifier which amplifies the signal for the transceiver (or a transmitter) to transmit it onwards.

There may be at least one relay. The at least one relay (and the transceivers or transmitters associated with the apparatus or at the surface) may be operable to transmit a signal for at least 200 m through the borehole. One or more relays may be configured to transmit for over 300 m, or over 400 m.

For acoustic communication there may be more than five, or more than ten relays, depending on the depth of the borehole and the position of the apparatus.

Generally, less relays are required for EM communications. For example, there may be only a single relay. Optionally therefore, an EM relay (and the transceivers or transmitters associated with the apparatus or at the surface) may be configured to transmit for over 500 m, or over 1000 m.

The transmission may be more inhibited in some areas of the borehole, for example when transmitting across a packer. In this case, the relayed signal may travel a shorter distance. However, where a plurality of acoustic relays are provided, preferably at least three are operable to transmit a signal for at least 200 m through the borehole.

For inductively coupled tubulars, a relay may also be provided, for example every 300-500 m in the borehole.

The relays may keep at least a proportion of the data for later retrieval in a suitable memory means.

Taking these factors into account, and also the nature of the borehole, the relays can therefore be spaced apart accordingly in the borehole.

The control signals may cause, in effect, immediate activation, or may be configured to activate the apparatus after a time delay, and/or if other conditions are present such as a particular pressure change.

Electronics

The apparatus may comprise at least one battery, optionally a rechargeable battery. The battery may be at least one of a high temperature battery, a lithium battery, a lithium oxyhalide battery, a lithium thionyl chloride battery, a lithium sulphuryl chloride battery, a lithium carbon-monofluoride battery, a lithium manganese dioxide battery, a lithium ion battery, a lithium alloy battery, a sodium battery, and a sodium alloy battery. High temperature batteries are those operable above 85° C. and sometimes above 100° C. The battery system may include a first battery and further reserve batteries which are enabled after an extended time in the borehole. Reserve batteries may comprise a battery where the electrolyte is retained in a reservoir and is combined with the anode and/or cathode when a voltage or usage threshold on the active battery is reached.

The control mechanism is normally an electronic control mechanism. The communication device is normally an electronic communication device.

The apparatus, especially the control mechanism, preferably comprises a microprocessor. Electronics in the apparatus, to power various components such as the microprocessor, control and communication systems, and optionally the valve, are preferably low power electronics. Low power electronics can incorporate features such as low voltage microcontrollers, and the use of 'sleep' modes where the majority of the electronic systems are powered off and a low frequency oscillator, such as a 10-100 kHz, for example 32 kHz, oscillator used to maintain system timing and 'wake-up' functions. Synchronised short range wireless (for example EM in the VLF range) communication techniques can be used between different components of the system to minimize the time that individual components need to be kept 'awake', and hence maximise 'sleep' time and power saving.

The low power electronics facilitates long term use of various components of the apparatus. The control mechanism may be configured to be controllable by the control signal up to more than 24 hours after being run into the borehole, optionally more than 7 days, more than 1 month, or more than 1 year or up to five years. It can be configured to remain dormant before and/or after being activated.

Tests

The method herein may be used to conduct pulse and/or interference tests.

The pressure changes may be caused by production, injection, perforating, closed chamber tests or other borehole tests in the first borehole. Normally they are caused by short or long term production. The pressure changes they cause may or may not be observed in the observing borehole.

Normally the borehole described herein is the observing borehole, where monitoring/observation occurs with the pressure sensor.

Deployment

The apparatus may be deployed with the barrier by being provided on the same string as the barrier and deployed into the borehole therewith. It may be retro-fitted into the borehole and moved past an annular seal. It is normally connected to a plug or hanger, and the plug or hanger in turn connected directly or indirectly, for example by tubulars, to the annular seal. The plug may be a bridge plug, wireline lock tubular/drill-pipe set barrier, shut-in tool or retainer such as a cement retainer. The plug may be a temporary or permanent plug.

Also, the apparatus may be provided in the borehole and then the barrier deployed and set thereabove and then the method described herein performed after the barrier is run in.

For certain embodiments, the apparatus may be deployed in a central bore of a pre-existing tubular in the borehole, rather than into a pre-existing annulus in the borehole. An annulus may be defined between the apparatus and the pre-existing tubular in the borehole.

The container, where present, may be sealed at the surface, and then deployed into the borehole. Thus the apparatus moves from the surface and is positioned below the barrier with the container sealed before activating the control device.

The aperture of the container may be provided within 100 m of a perforation between the borehole and the reservoir, optionally 50 m or 30 m. If there is more than one perforation, then the closest perforation is used to determine the spacing from the aperture of the apparatus. Optionally therefore, the aperture in the container may be spaced below perforations in the borehole. This can assist in drawing perforation debris away from the perforation(s) to help clear them.

A plurality of apparatus and optionally barriers described herein may be run on the same string, for example, spaced apart and positioned adjacent one zone or separate zones. Thus, the apparatus may be run in a borehole with multiple different zones. In such a scenario, there may not be straightforward access below perforating devices to the lower zone(s). Thus when run with such a string, embodiments of the invention provide means to manipulate such a zone.

Miscellaneous

The borehole may be a subsea borehole. Wireless communications can be particularly useful in subsea boreholes because running cables in subsea boreholes is more difficult compared to land boreholes. The borehole may be a deviated or horizontal borehole, and embodiments of the present invention can be particularly suitable for such boreholes since they can avoid running wireline, cables or coiled tubing which may be difficult or not possible for such boreholes. For example, the borehole could be a lateral section of a borehole e.g. multilateral borehole.

References herein to a perforating device includes perforating guns, punches or drills, all of which are used to create a perforation between the casing and the borehole.

The volume of the container is its fluid capacity.

Transceivers, which have transmitting functionality and receiving functionality; may be used in place of the transmitters and receivers described herein.

Unless indicated otherwise, any references herein to "blocked" or "unblocked" includes partially blocked and partially unblocked.

All pressures herein are absolute pressures unless stated otherwise.

The borehole is often an at least partially vertical borehole. Nevertheless, it can be a deviated or horizontal borehole. References such as "above" and below" when applied to deviated or horizontal boreholes should be construed as their equivalent in boreholes with some vertical orientation. For example, "above" is closer to the surface of the borehole.

A zone is defined herein as a formation adjacent to or below the lowermost barriers, or a portion of the formation adjacent to the borehole which is isolated in part between barriers and which has, or will have, at least one communication path (for example perforation) between the borehole and the surrounding formation, between the barriers. Thus each additional barrier set in the borehole defines a separate zone, except areas between two barriers (for example a double barrier) where there is no communication path to the surrounding formation and none are intended to be formed.

The surface of the well is the top of the uppermost casing of the well. The "surface" is above the surface of the well.

"Kill fluid" is any fluid, sometimes referred to as "kill weight fluid", which is used to provide hydrostatic head typically sufficient to overcome reservoir pressure.

BRIEF DESCRIPTION OF THE DRAWINGS

Embodiments of the present invention will now be described by way of example only and with reference to the accompanying drawings, in which.

DETAILED DESCRIPTION

Figure 1:
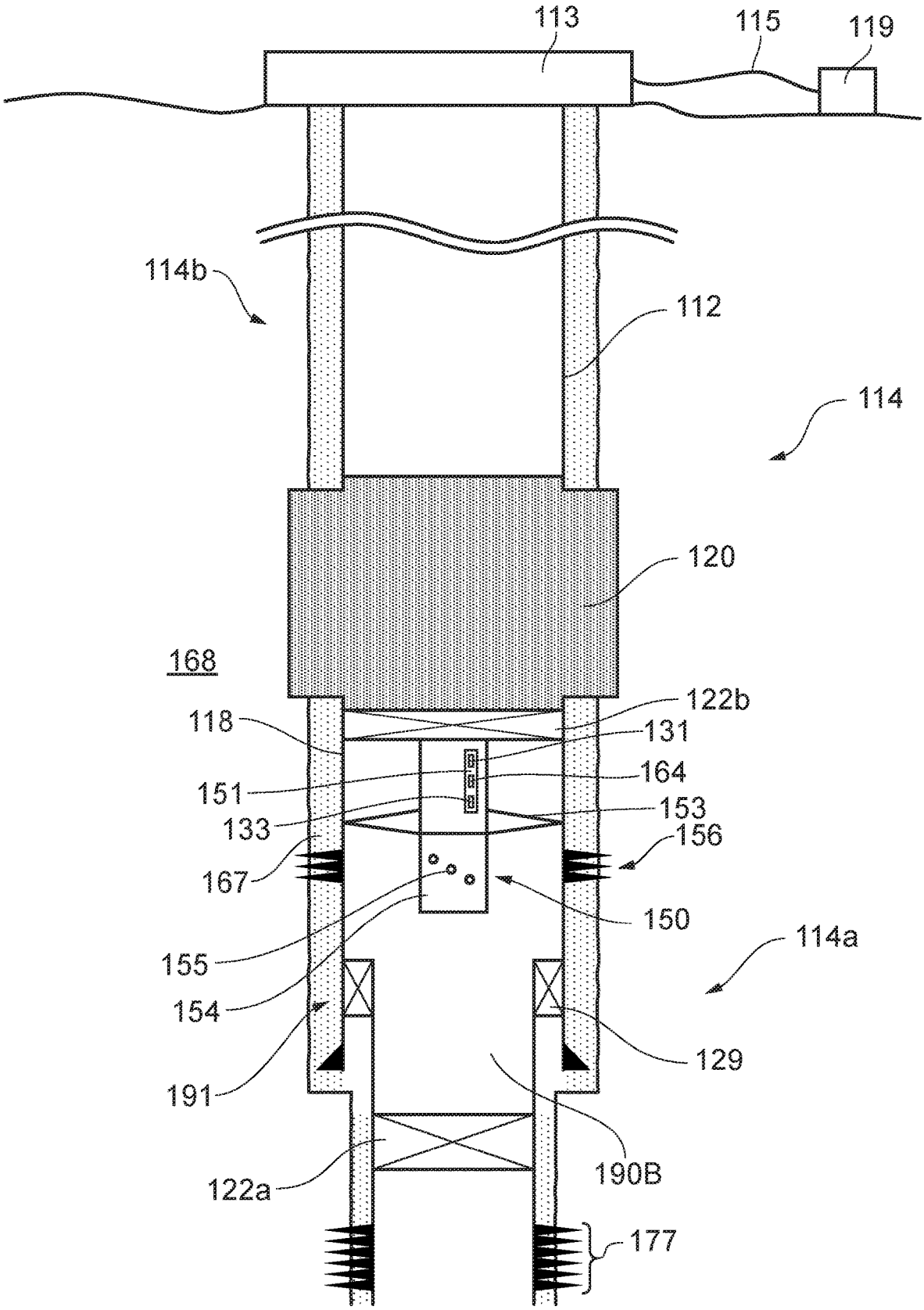
FIG. 1 is a diagrammatic sectional view of a section of a borehole and an assembly of a first embodiment of the present invention monitoring the pressure integrity of a cement barrier.

FIG. 1 shows a section of a borehole and an assembly/apparatus of a first embodiment of the present invention, involving monitoring of the pressure integrity of a cement barrier bonded to the formation.

FIG. 1 shows a section of a borehole 114 of an abandoned well comprising an upper section of casing string 112 and lower section of a casing string 118, separated by a cement barrier 120. An assembly/apparatus 150 is provided below the cement barrier, with a perforating gun 154, a monitoring mechanism 151 comprising a pressure sensor 131, a wireless transceiver 164 and a battery 133.

The well further comprises a cap 113 at the top of the borehole 114, and a cable 115 and a communication box 119 to form a spaced contact at the top of the borehole 114 to detect and transmit electromagnetic signals. These signals may be received from/sent to various downhole communication devices including the wireless transceiver 164 of the apparatus 150, and/or the gun controller, these devices being described in more detail below. The communication box 119 is used as an interface to a local or remote data acquisition and/or control system.

The pressure integrity of the cement barrier 120 is monitored within an isolated section 190B inside the casing string 118 between a bridge plug 122*a* and the cement barrier 120. Pressure information detected by mechanism 151 may be communicated to the surface (not shown) of the borehole 114 by signals transmitted from the wireless transceiver 164 of the apparatus 150. In this embodiment, apparatus 150 is connected to the casing 118 by an EM communication connector 153 which enables transmission of EM signals from the isolated section 190B to the surface.

The cement barrier 120 is located immediately above a further bridge plug or anchor 122*b*. The cement barrier 120 may be formed using a conventional method, involving adding an initial barrier (plug 122*a*) to control the borehole, and milling out a section of casing (and any adjacent cement) thereabove. A section of the formation may also be cut away using a reamer. Plug or anchor 122*b* is set to provide a base for fresh cement which is then placed into this area to create the cement barrier 120 that seals across the borehole 114 and bonds with the surrounding geological formation 168. Borehole 114 is thus sealed by cement barrier 120, thus abandoning the section of the borehole 114*a* therebelow.

The perforating gun 154 is mounted within the casing string 118. In use, a gun-controller (not shown) receives an EM control signal to activate the perforating gun 154, which then creates radially and vertically spaced perforations 156 in the casing 118 and the pre-existing cement 167 in an annulus 191 between the casing string 118 and the formation 168. This allows pressure communication between the annulus 191 and the isolated section 190B.

The pre-existing cement 167 in the annulus 191 (which may be decades old) may provide a leak path through which fluids can travel. Therefore, cement barrier 120 should be sealed against the formation. The creation of perforations 156 means that the cement barrier 120 is tested for its integrity, as described below, not only in the central area of the borehole but also in its bond with the formation 168 to ensure any leaks which may be present through the pre-existing cement 167 therebelow cannot propagate between the cement barrier 120 and the formation 168. The full extent of the cement barrier seal is therefore tested.

A pressure difference is then created between the isolated section 190B and the borehole 114*b* above cement barrier 120. This may be achieved by, for example, applying a greater pressure from the surface on the upper side of the cement barrier 120, and/or by creating a pressure increase or drop within isolated section 190B. Such pressure changes may be created by using a pump or suitably over/under-pressurised container within the isolated section 190B, such as that shown in FIGS. 3*a*-3*c*, described below. An alternative method is to use the pressure drop that results from firing the guns. Upon detonation of shaped charges and creation of apertures 155, fluid surges into the perforating gun 154 (and optionally an associated container, such as that shown in FIG. 3*a*) thus creating an underbalance of pressure in the isolated section 190B.

Therefore, if there is a leak-path present in the so-called isolated section 190B then this will normally result in a change in the monitored pressure distinct from any pressure change expected by, for example, firing the perforating device. Notably, because of the presence of the perforations 156, if there is any failure of the bond between the cement barrier 120 and the formation (and a leak path in the annulus 191 therebelow) then this can also be observed by monitoring the pressure in the isolated section 190B.

The change in pressure in such a circumstance is usually indicative of some kind of failure of the cement barrier 120 though may additionally or alternatively be due to a liner hanger 129 or other parts of the so-called isolated section 190B leaking, such as the pre-existing cement in the annulus 191 below the perforations 156. If doubt exists, both pressure tests described above may be performed in order to determine which part of the isolated section 190B is causing the leak.

The perforating gun 154 may be optimised to create perforations in the casing 118 and the adjacent cement in the annulus 191, but not extend into the formation 168 to the same extent required when providing flowpaths for fluid communication from a reservoir, such as perforations 177. Whilst the perforations 156 may extend into the formation to an extent, the formation is usually impermeable in this area (if not, it is impermeable around the cement barrier) and so no leak path is provided by the formation between the upper and lower sections.

The inventors of the present invention have noted that the use of a pressure sensor below a barrier provides information on the integrity of the barrier seal which is an improvement over the known method of monitoring the pressure above the barrier seal where the volume of the borehole 114*b* above the cement barrier 120 can be large, meaning small leaks will create a more subtle change in pressure which may not be observed and diagnosed so readily.

Moreover, the provision of the pressure sensor 131 below the barrier 120 can also confirm that any lower barrier, such as the liner hanger 129, is also sealed whereas pressure monitoring from above does not provide this information. A further pressure sensor (not shown) may be provided between the bridge plug/anchor 122*b* and the cement barrier 120 above which can help verify in tests described below that it is the long term cement barrier which is containing pressure.

A further advantage is that a positive pressure test below the barrier tests the barrier in the direction the barrier is intended to seal, thereby providing a more realistic pressure test. Similarly, a negative pressure test below the barrier performs a test for any lower barrier, such as the liner hanger 129, in the direction the lower barrier is intended to seal.

Figure 3A:
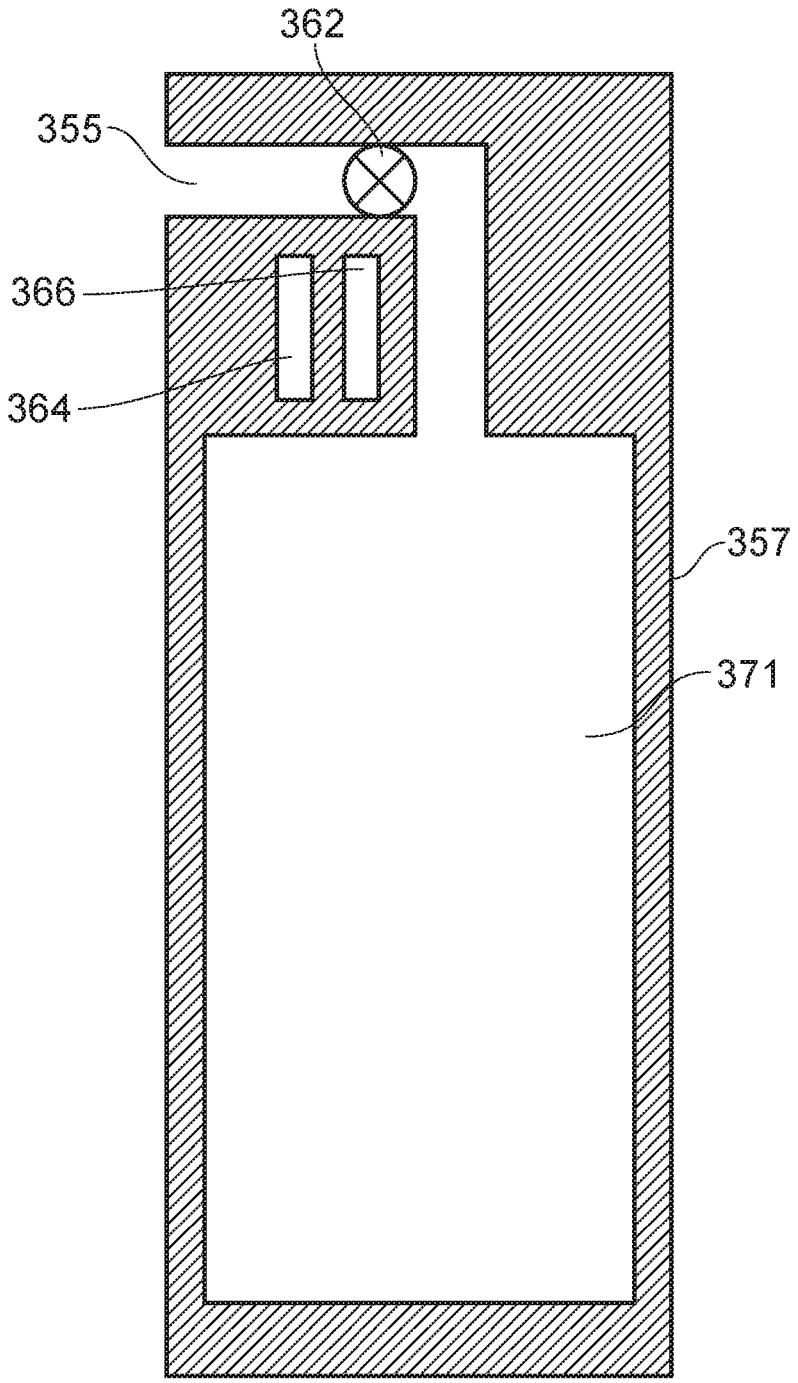
Figure 3B:
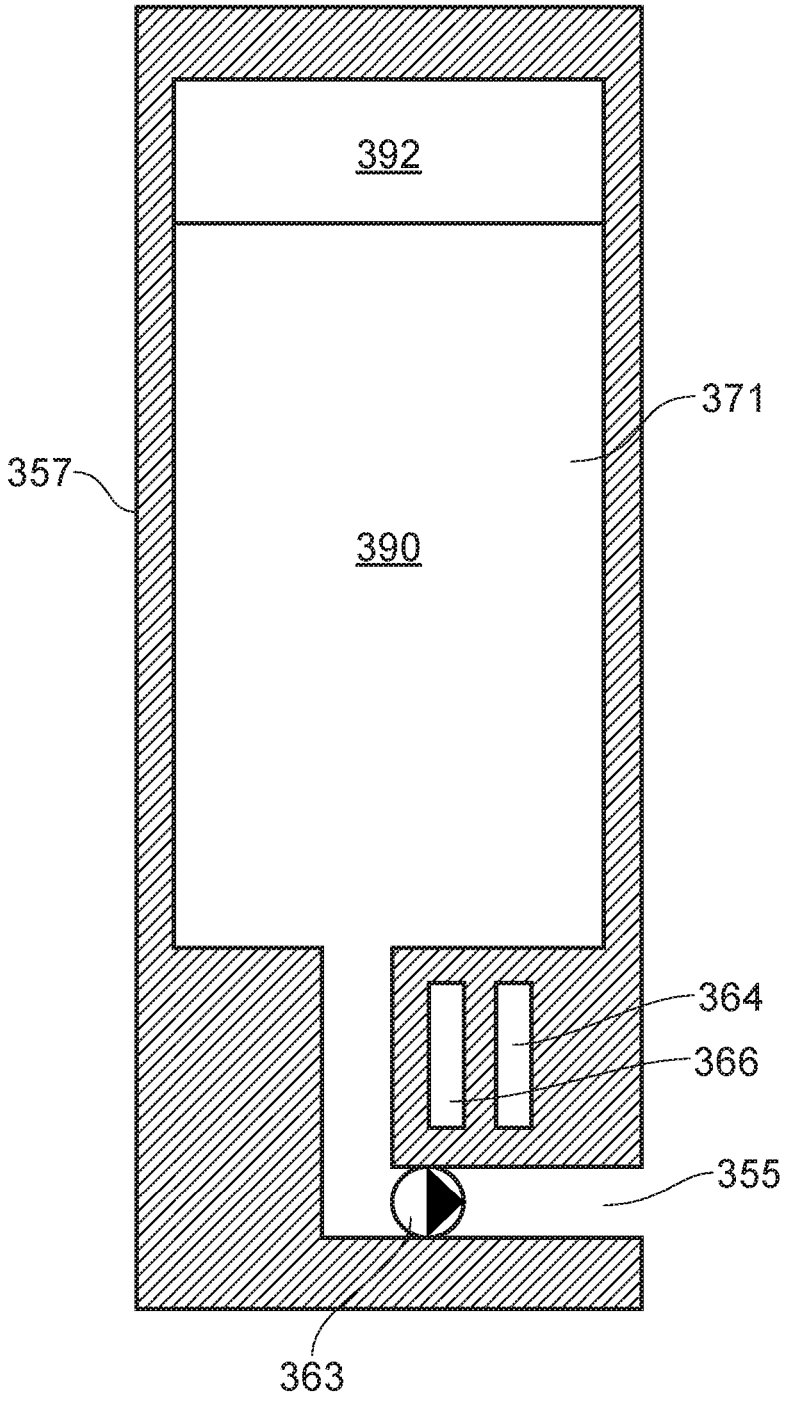
Figure 3C:
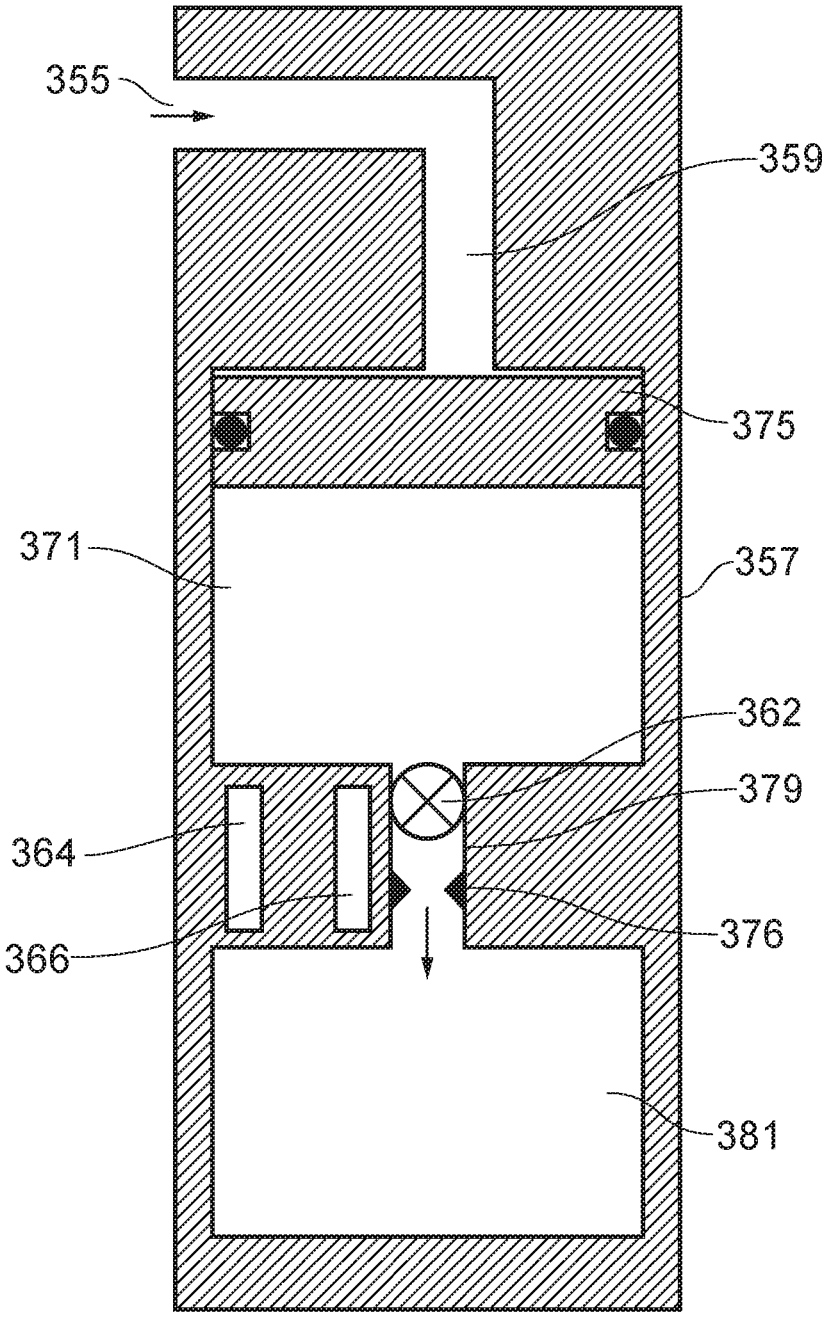

For certain embodiments, a pressure test may be conducted before, as well as after, the perforating device 154 is activated to create perforations 156 in the casing 118 and cement. This can provide a baseline figure to test the cement barrier 120 in the central area before the remaining cement plug and particularly its bond with the formation 168 is also tested, as described above. For example, various containers are shown in FIGS. 3*a*-3*c* may be used to create a pressure change in the lower section before the perforations are created.

The cement for the cement plug may be placed by various methods including circulating, squeezing and/or dumping a cement slurry. In alternative embodiments, cement substitutes may be used such as Sandaband™, or indeed a thermite or other melting process used instead of cement.

In modified embodiments, a further perforating device may be provided above the cement plug and activated to provide a flow path through the adjacent casing. This further assesses the integrity of the cement plug and its bond to the formation.

Figure 2:
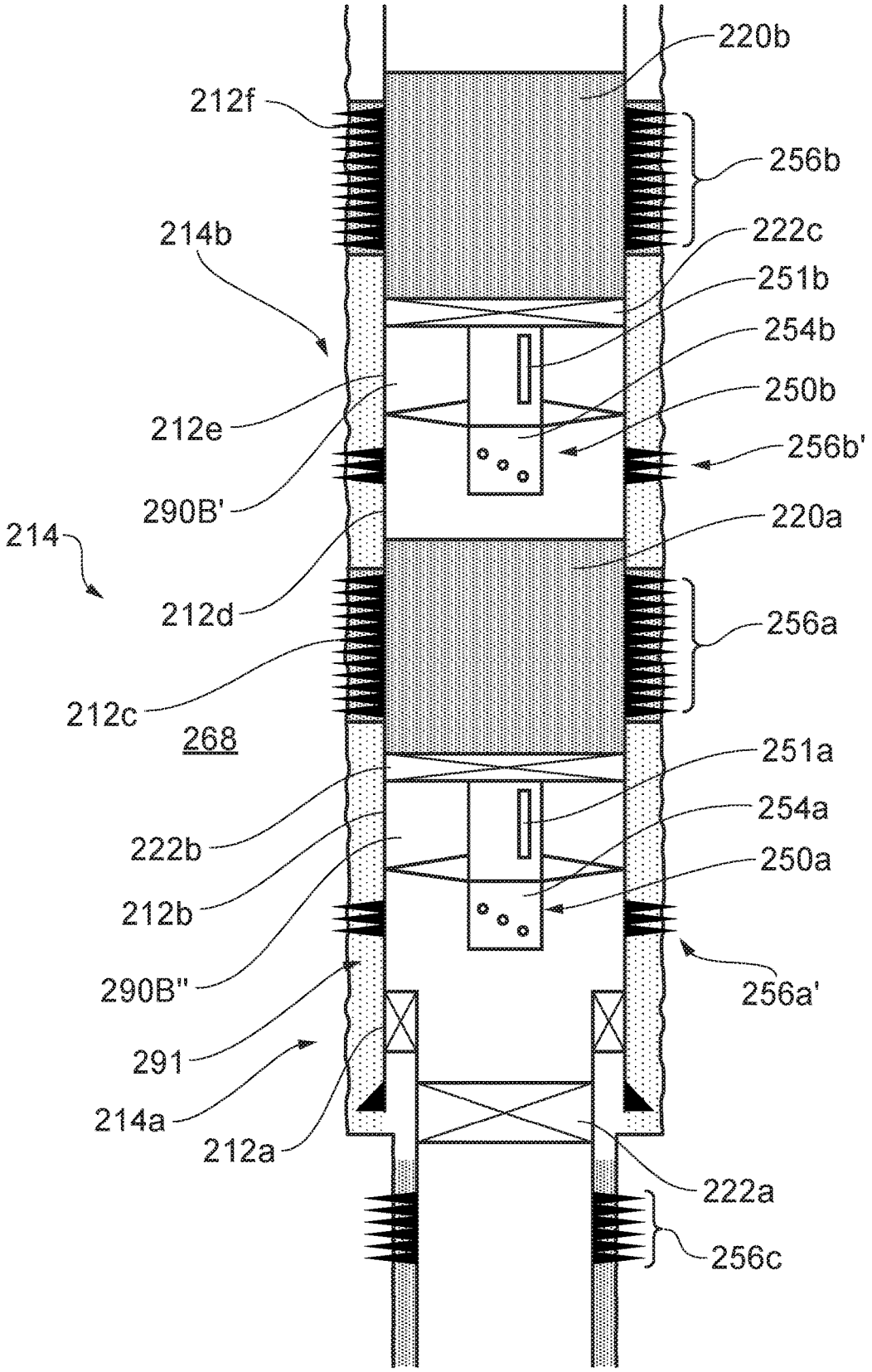
FIG. 2 is a diagrammatic sectional view of a section of a borehole and an assembly formed in a different way from that of FIG. 1, monitoring two cement barriers; and, FIGS. 3*a*-*c* are schematic views of various apparatus with different containers used in certain embodiments.

FIG. 2 shows a further development of the FIG. 1 embodiment, with similar features, illustrating two cement plugs. Like parts with the FIG. 1 embodiment are not described in detail but are prefixed with a '2' instead of a '1'. In this embodiment, the pressure integrity of multiple cement barriers are being tested, as opposed to the single cement barrier test that was described in the FIG. 1 embodiment.

FIG. 2 shows a borehole 214 comprising, respectively, upper and lower cement barriers 220*b* & 220*a*, assemblies/apparatuses 250*b* & 250*a*, and perforating guns 254*b* & 254*a*. As with the embodiment described in FIG. 1, the FIG. 2 apparatus is normally positioned adjacent fluid-impermeable cap rock formation 268.

Also as with the FIG. 1 embodiment, the FIG. 2 embodiment comprises, at the top of the borehole 214, a cap(not shown), and a cable(not shown) and a communications box (not shown) forming a spaced contact to detect and transmit electromagnetic signals. These signals may be received from/sent to various objects within the borehole 214 including the perforating guns 254*b* and/or 254*a*, and/or from the monitoring mechanisms 251*b* and/or 251*a*, which are themselves described in more detail below.

The pressure integrity of the isolated section defined inside each section of the casing string is monitored, isolated section 290B" being defined between bridge plug 222*a* and cement barrier 220*a*; and isolated section 290B' being defined between cement barriers 220*a* & 220*b*.

The cement barriers 220*a* & 220*b* are formed using a different method than was described in relation to the FIG. 1 embodiment, involving perforating the borehole with perforating guns (not shown), and washing out at least a portion of any cement and other debris in the annular space 291 between the casing 212*c*, 212*f* and formation 268. A spacer fluid is then pumped into the annular space 291, before cement is placed. The cement is placed inside the casing 212*c*, 212*f*, and extends through the perforations 256*a* & 256*b* into the annulus 291.

Perforating guns 254*b* & 254*a* may be activated independently, optionally using wireless signals, creating perforations 256*b*' & 256*a*' respectively. The perforations, as for the FIG. 1 embodiment, allow each cement barrier 220*a*, 220*b* to be tested for its integrity, not only in the central area of the borehole 214, but also across its full width and its bond with the casing 212*c*, 212*f* and formation 268.

A pressure difference is then created between isolated sections 290B' & 290B". Any changes in pressure within the isolated sections 290B' & 290B" are detected using monitoring mechanisms 251*b* and/or 251*a*, thereby allowing testing and monitoring of the integrity of the upper and lower cement barriers 220*a*, 220*b* in the borehole 214. The data detected is then recovered wirelessly, for example by EM comms.

An advantage of the FIG. 2 embodiment is that it can be verified that there are two separate seals in the borehole. For certain embodiments, FIG. 2 embodiments with two cement seals can each have a shorter length (for example 25 metres each) which together make up the length used for a FIG. 1 embodiment with a single cement seal (for example 50 metres).

Two cement barriers illustrated in FIG. 2 are preferred for longer term monitoring since the bond between the upper cement barriers 220*b* and the formation 268 can be verified (typically using a pressure sensor between the cement barriers) even if there are leaks in the area below the cement barriers e.g. below the perforations 256*a*. In contrast, for single cement barrier embodiments it is more difficult/not possible to verify the bond between the cement barrier and the formation if there are further leaks in the area below the cement barrier e.g. below the perforations 256 in FIG. 1.

Optionally, further monitoring, such as of the reservoir, may be performed through further perforations 256*c* in the reservoir using suitable apparatus as described herein.

For other embodiments, the apparatus may be provided in the well by a number of means such as being hung off non-sealing components like a cement wiper; or on top of a liner hanger or bridge plug.

Thus a number of different perforation steps may occur: perforation below the formed cement barrier to facilitate testing of it, perforation above the cement barrier to also aid testing of it, perforation to assist in clearing the section before placing a cement barrier, and perforation for access to monitor the reservoir.

Rather than a perforating gun with multiple charges, other perforating devices may be used such as a perforating punch, which can fire a single projectile and form a single perforation especially for the perforation between the formed cement barrier.

For certain embodiments therefore, the two cement barriers, as exemplified in FIG. 2, may be provided. In other embodiments, a second cement barrier may be added after a single cement barrier (for example FIG. 1) has been set and tested.

In alternative embodiments, the second apparatus 250*b* is not be necessary even where two cement barriers are provided.

The two methods of forming the cement plug described in FIG. 1 and FIG. 2 respectively, may be used in either the single (FIG. 1) or double (FIG. 2) embodiments. Moreover, whilst EM comms are illustrated, acoustic or other wireless communications systems may be used. For example, a wireline probe may be lowered into the borehole 114/214 from a surface vessel such as a rig, to above the cement barrier 120/220 e.g. to around 10 metres above.

The operation of creating the dual cement barrier may be performed with a single run of pipe in the borehole. For example, with reference to the FIG. 2 embodiment, the two sets of perforations 256*a*, 256*b* may be created and perforating devices optionally dropped in the borehole and the perforations washed. The lower apparatus 250*a* may be released from the pipe and secured via the anchor 222*b*. The lower cement barrier 220*a* may then be placed prior to setting the upper apparatus 250*b* through an anchor 222*c* and placing the upper cement barrier 220*b*. Control of and release of the apparatus 250*a*/250*b* and operation of the guns for the 256*a* and 256*b* may be by wireless, or conventional ball/bar dropping or rotary mechanisms.

Whilst reference above is made to pre-existing cement, casing strings often include a section where they are not cemented to the formation. Consequently, in certain embodiments there is no pre-existing cement in the annulus between the casing string and the formation where the perforations such as 256*a*' 256*b*' in FIG. 2 or new cement seal such as 256*a*, 256*b*, is formed.

As noted above, the apparatus 250*a* in the isolated section 290B' may comprise a container to drop (or raise if required) the pressure therein to conduct a pressure test on the isolated section, in particular the cement barrier 220*a*. The FIG. 3*a* apparatus comprises a container 357, an aperture 355, a valve 362, and a control mechanism with a multi-purpose controller 366 and a wireless receiver (or transceiver) 364. The valve 362 is located in the aperture 355 of the apparatus, and the aperture leads to a fluid chamber 371 inside the container 357. Other components of the apparatus, such as the perforating gun and monitoring mechanism are not shown in FIGS. 3*a*-3*c*.

The valve 362 is configured to seal the container 357 from the surrounding portion of the well in a closed position and allow pressure and fluid communication between the fluid chamber 357 and the surrounding portion of the well via the aperture 355 in an open position.

In some embodiments, the fluid chamber 371 is filled with a gas, such as air, initially at atmospheric pressure. In such embodiments, the gas is sealed in the container at the surface before being run into the well to create an underbalance of pressure between the container and the isolated section (which is at a higher pressure than atmospheric pressure on the surface).

In other embodiments, the fluid chamber 371 may be filled with a gas or fluid that comprises a higher pressure than the isolated section, thus creating an overbalance of pressure therein.

In addition to or instead of the valve 362, a pump may be provided to transfer fluids between the fluid chamber 371 and the surrounding portion of the well, regardless of the relative pressures between the fluid chamber 371 and surrounding portion of the well.

For example, in FIG. 3*b* there is located an electrically powered pump 363 within the aperture 355 of the container 357. The fluid chamber 371 is filled with a liquid 390 and a gas 392.

The pump 362 pumps fluids from/to the container 357 to/from a surrounding portion of the well (outside the apparatus) thus selectively allowing fluid communication between a portion of the container 357 and the isolated section. The gas 392 can be suitably pressurised to facilitate the pumping or provided to stop the pump 362 drawing against a vacuum.

Optionally a floating piston, equivalent to 375 in FIG. 3*c*, may separate the gas 392 and liquid 390 phases in FIG. 3*b*.

An alternative embodiment of the container apparatus in FIG. 3*b* is the assembly or apparatus of FIG. 3*c*. The FIG. 3*c* apparatus comprises an aperture 355; a valve 362; a choke 376; a control mechanism with a multi-purpose controller 366 and a wireless receiver (or transceiver) 364; and a container 357. The valve 362 and the choke 376 are located in a central portion of the apparatus in an aperture 379 between two sections of the container 357—a fluid chamber 371 and a dump chamber 381.

In some embodiments, the dump chamber 381 is filled with a gas, such as air, initially at atmospheric pressure. In such embodiments, the gas is sealed in the container 357 at the surface before being run into the well. This helps to create an underbalance of pressure, for example 1,000 psi to 10,000 psi, between the container 357 and the surrounding portion of the well (which is at a higher pressure than atmospheric pressure on the surface).

A floating piston 375 is located in the fluid chamber 371. The fluid chamber 371 is initially filled with oil below the floating piston 375 through a fill aperture (not shown). When the floating piston 375 is located at the top of the fluid chamber 371 it isolates/closes the fluid chamber 371 from the surrounding portion of the well, and when the floating piston 375 moves towards the bottom of the fluid chamber 371 the opening 355 allows fluid to enter the fluid chamber 371 via flow aperture 359 from outside of the container, normally the surrounding portion of the well. The location of the floating piston 375 is controlled indirectly by the flow of fluid through the valve 362, which is in turn controlled via signals sent to the multi-purpose controller 366. In use, the sequence begins with the valve 362 in the closed position and the floating piston 375 located towards the top of the fluid chamber 371. Fluid in the well is resisted from entering the fluid chamber 371 via the aperture 355 by the floating piston 375 and oil therebelow whilst the valve 362 is in the closed position. A signal is then sent to the multi-purpose controller 366 instructing the valve 362 to open. Once the valve 362 opens, oil from the fluid chamber 371 is directed into the dump chamber 381 by the well pressure acting on the floating piston 375, and fluids from the surrounding portion of the well are drawn into the fluid chamber 371. The rate at which the oil in the fluid chamber 371 is expelled into the dump chamber 381, and consequentially the rate at which the fluids from the well can be drawn into the container 357, is controlled by the cross-sectional area of the choke 376.

It is an advantage of the FIG. 3*c* embodiment that the floating piston and choke can help to control the rate of flow of well fluids from the surrounding portion of the well into the container, which may allow more accurate data to be obtained and better analysis of the well and reservoir to be performed.

The FIG. 3*c* apparatus may be rearranged in order to expel fluid from the fluid chamber 371 into the surrounding portion of the well. In such an embodiment the chamber 381 is a drive chamber containing gas at a higher pressure than the surrounding portion of the well and upon opening the valve 362, the higher, overbalanced, pressure from the drive chamber 381 causes the floating piston 375 to move from the bottom of the fluid chamber 371 towards the aperture 355. As the effective volume of the fluid chamber 371 decreases, a stored fluid is expelled from the fluid chamber 371 through aperture 355 and into the surrounding portion of the well.

The valve 362 can be provided where indicated between the drive chamber 381 and fluid chamber 371 or instead located in the aperture 355.

A further option involves a pump replacing the valve 362.

In some embodiments, the container may be overbalanced, or have an overbalance portion, that is an area of increased pressure compared to a surrounding portion of the well. In such embodiments, once a valve is opened, there is a surge of fluid from the container into the surrounding portion of the well.

For certain embodiments, the valve may be opened immediately after the perforating guns have activated. In other embodiments, the opening of the valve may be delayed for some time after the perforating gun has fired. Likewise, the activation of the perforating guns may be delayed after the barrier is set. The activation of the perforating guns could also occur after the rig connected to the well has been removed.

In some alternative embodiments, one or a first group of shaped charges provided in the perforating gun may be detonated before a second or second group of shaped charges.

Further embodiments may have multiple perforating guns, where each perforating gun may be separated by a barrier, such as a bridge plug or a packer.

The containers 357 can have a volume capacity of, for example, 1000 litres.

Embodiments described herein may be combined. For example the methods described in any of FIGS. 1-2 may be used in the same borehole with the containers described in FIGS. 3*a*-3*c*.

That claimed is:

1. A downhole monitoring method comprising:

setting at least one barrier in a cased borehole, the at least one barrier including a column of flowable sealing material, having a height of at least 2 m, such that pressure and fluid communication are resisted across the borehole thus separating the borehole into a lower section below the at least one barrier and an upper section above the at least one barrier;

bonding said column of flowable sealing material to a portion of formation which defines a portion of the borehole, wherein the portion of the formation on which the column of flowable material is bonded to is a first impermeable portion;

at least a portion of the lower section being cased with casing, thus defining an annulus between a surrounding part of the formation and the casing;

wherein there is provided an assembly in the lower section, including:

a perforating device;

a control mechanism to control the perforating device, and comprising a wireless communication device configured to receive a wireless control signal for activating the perforating device;

a pressure sensor;

after the at least one barrier is set, sending the wireless control signal to the wireless communication device to activate the perforating device, the wireless control signal transmitted in at least one of the following forms: electromagnetic and acoustic;

after the at least one barrier is set such that pressure and fluid communication are resisted across the borehole, activating the perforating device in the lower section below the at least one barrier, in order to create at least one perforation through the casing, wherein the perforation(s) are created adjacent a second impermeable portion of the formation;

after the perforating device has been activated:

(i) monitoring the pressure in the lower section below the at least one barrier using the pressure sensor;

(ii) sending a wireless data signal including pressure data from below the at least one barrier to above the at least one barrier, using at least one of electromagnetic communication and acoustic communication, and after step (ii), (iii) assessing whether the lower section is, or to what extent, isolated from the upper section.

2. A method as claimed in claim 1, including monitoring the pressure over time in order to assess whether the lower section is, or to what extent, isolated.

3. A method as claimed in claim 1, including the step of monitoring the pressure above and below said at least one barrier.

4. A method as claimed in claim 1, including clearing a section of the formation thus removing at least a portion of any pre-existing cement in contact with the formation; then setting the at least one barrier, at least in part, in said section.

5. A method as claimed in claim 4, wherein the step of clearing said section of the formation includes removing a portion of the casing and at least a portion of any pre-existing cement in contact with the formation, in said section.

6. A method as claimed in claim 4, wherein the step of clearing said section of the formation includes an earlier perforating step of perforating a portion of casing in said section, and washing out at least a portion of any pre-existing cement in contact with the formation.

7. A method as claimed in claim 1, wherein an upper perforating device is provided, the upper perforating device provided in the upper section above the at least one barrier, and the method includes creating at least one perforation between the borehole and the casing above the at least one barrier.

8. A method as claimed in claim 1, wherein the at least one barrier remains in place for at least 1 month.

9. A method as claimed in claim 1, including monitoring a reservoir after the at least one barrier is set by using a further pressure sensor in the borehole below the at least one barrier.

10. A method as claimed in claim 1, wherein the at least one barrier remains in place for at least 1 year.

11. A method as claimed in claim 1, wherein the assembly comprises a battery.

12. A method as claimed in claim 1, wherein the at least one barrier is a primary barrier and at least one secondary barrier including a second column of flowable sealing material, is set below the assembly, such that the at least one secondary barrier resists pressure and fluid communication across the borehole, thus isolating a section of the borehole between the primary and secondary barrier, from a section of the borehole below the secondary barrier.

13. A method as claimed in claim 12, the pressure sensor is a primary pressure sensor and the borehole includes a secondary pressure sensor below the at least one secondary barrier.

14. A method as claimed in claim 13, wherein the assembly is a primary assembly the perforating device a primary perforating device, the control mechanism a primary control mechanism and the wireless communication device a primary wireless commutation device and a secondary assembly is provided below the at least one secondary barrier, the secondary assembly including:

the secondary pressure sensor;

a secondary perforating device;

a secondary control mechanism to control the perforating device, and comprising a secondary wireless communication device configured to receive a wireless control signal for activating the perforating device;

the method includes:

at any time, sending a wireless control signal to the secondary wireless communication device to activate the secondary perforating device, the wireless control signal a transmitted in at least one of the following forms: electromagnetic, acoustic, and inductively coupled tubulars;

after the at least one secondary barrier is set, activating the secondary perforating device, in order to create at least one perforation between the borehole and the casing;

monitoring the pressure in the section below the secondary barrier using the secondary pressure sensor; and, sending a wireless data signal including pressure data from below the secondary barrier to above the secondary barrier, using at least one of electromagnetic communication, acoustic communication and inductively coupled tubulars.

15. A method as claimed in claim 1, wherein the assembly includes a container, and the method includes causing fluid movement through an aperture between an inside and an outside of the container.

16. A method as claimed in claim 15, wherein immediately before fluid movement through the aperture, the pressure inside at least a portion of the container is at least 500 psi lower than the pressure outside the container.

17. A method as claimed in claim 15, wherein the direction of fluid movement is from inside the container to outside the container.

18. A method as claimed in claim 15, wherein there is at least 5 litres (1) of fluid movement through the aperture between the inside and the outside of the container.

19. A method as claimed in claim 15, wherein the aperture provides a cross-sectional area for fluid entry, which is at least 0.1 $cm^2$.

20. A method as claimed in claim 15, wherein the aperture provides a cross-sectional area for fluid entry, which is at most 150 $cm^2$.

21. A method as claimed in claim 15, wherein the aperture is formed by the activation of the perforating device.

22. A method as claimed in claim 21, wherein fluid movement between the inside and outside of the container takes place after the activation of the perforating device.

23. A method as claimed in claim 15, wherein the fluid movement between the inside and outside of the container takes place before the activation of the perforating device.

24. A method as claimed in claim 15, wherein the aperture is a pre-existing aperture in the container, and a wirelessly controlled control device that one of allows and resists fluid movement between the inside and the outside of the container via the aperture.

25. A method as claimed in claim 24, wherein the control device is at the aperture.

26. A method as claimed in claim 24, wherein the control device comprises a mechanical valve assembly.

27. A method as claimed in claim 15, wherein the container has a volume of at least 5 l and at most 3000 l.

28. A method as claimed in claim 15, wherein the container a is sealed at the surface, and then deployed into the borehole such that the assembly moves from the surface into the borehole with the container sealed.

29. A method as claimed in claim 15, wherein there is a plurality of containers, each independently being at least one of an underbalanced container having a pressure less than a surrounding portion of the borehole, an overbalanced container having a pressure greater than a surrounding portion of the borehole, and a pump controlled container where fluid movement between the container and a surrounding portion of the borehole is controlled by a pump.

30. A method as claimed in claim 15, wherein immediately before fluid movement through the aperture, the pressure inside at least a portion of the container is at least 500 psi higher than the pressure outside the container.

31. A method as claimed in claim 1, wherein the lower section is at least one of suspended and abandoned.

32. A method as claimed in claim 1, wherein the entire borehole is at least one of suspended and abandoned.

33. A method as claimed in claim 1, wherein at least one of the wireless data signal and wireless control signal is sent for at least 200 m.

34. A method as claimed in claim 1, wherein at least one of the wireless data signal and wireless control signal comprises an acoustic signal.

35. A method as claimed in claim 1, wherein the lower section below the at least one barrier defines an abandoned or suspended borehole.

36. A method as claimed in claim 1, wherein at least one of the wireless data signal and wireless control signal comprises an electromagnetic signal in at least one of: the sub-ELF, and ELF frequency bands.

37. A method as claimed in claim 1 wherein at least one of the wireless data signal and wireless control signal comprises an electromagnetic signal using one of the following methods: imposing a modulated current on an elongate member and using the formation as return; creating a current loop within a portion of the borehole metalwork in order to create a potential difference between the metalwork and formation; use of spaced contacts to create an electric dipole transmitter.

38. A downhole monitoring method comprising:

setting at least one barrier in a cased borehole, the at least one barrier including a column of flowable sealing material, having a height of at least 2 m, such that pressure and fluid communication are resisted across the borehole thus separating the borehole into a lower section below the at least one barrier and an upper section above the at least one barrier;

bonding said column of flowable sealing material to a portion of formation which defines a portion of the borehole, wherein the portion of the formation on which the column of flowable material is bonded to, is a first impermeable portion;

at least a portion of the lower section being cased with casing, thus defining an annulus between a surrounding part of the formation and the casing;

wherein there is provided an assembly in the lower section, including:

a perforating device;

a control mechanism to control the perforating device, and comprising a wireless communication device configured to receive a wireless control signal for activating the perforating device;

a pressure sensor;

after the at least one barrier is set, sending the wireless control signal to the wireless communication device to activate the perforating device, the wireless control signal transmitted in at least one of the following forms: electromagnetic, acoustic, inductively coupled tubulars and coded pressure pulsing;

after the at least one barrier is set such that pressure and fluid communication are resisted across the borehole, activating the perforating device in the lower section below the at least one barrier, in order to create at least one perforation through the casing, wherein the perforation(s) are created adjacent a second impermeable portion of the formation;

after the perforating device has been activated:

(i) monitoring the pressure in the lower section below the at least one barrier using the pressure sensor; and, (ii) sending a wireless data signal including pressure data from below the at least one barrier to above the at least one barrier, using at least one of electromagnetic communication and acoustic communication;

wherein the method further comprises clearing a section of the formation thus removing at least a portion of any pre-existing cement in contact with the formation; then setting the at least one barrier, at least in part, in said section.

39. A method as claimed in claim 38, wherein the step of clearing said section of the formation includes removing a portion of the casing and at least a portion of any pre-existing cement in contact with the formation, in said section.

40. A method as claimed in claim 38, wherein the step of clearing said section of the formation includes an earlier perforating step of perforating a portion of casing in said section, and washing out at least a portion of any pre-existing cement in contact with the formation.

41. A method as claimed in claim 37, wherein the lower section below the at least one barrier defines an abandoned or suspended borehole.

42. A downhole monitoring method comprising:

setting at least one barrier in a cased borehole, the at least one barrier including a column of flowable sealing material, having a height of at least 2 m, such that pressure and fluid communication are resisted across the borehole thus separating the borehole into a lower section below the at least one barrier and an upper section above the at least one barrier;

bonding said column of flowable sealing material to a portion of formation which defines a portion of the borehole, wherein the portion of the formation on which the column of flowable material is bonded to is a first impermeable portion;

at least a portion of the lower section being cased with casing, thus defining an annulus between a surrounding part of the formation and the casing;

wherein there is provided an assembly in the lower section, including:

a perforating device;

a control mechanism to control the perforating device, and comprising a wireless communication device configured to receive a wireless control signal for activating the perforating device;

a pressure sensor;

after the at least one barrier is set, sending the wireless control signal to the wireless communication device to activate the perforating device, the wireless control signal transmitted in at least one of the following forms: electromagnetic, acoustic, inductively coupled tubulars and coded pressure pulsing;

after the at least one barrier is set such that pressure and fluid communication are resisted across the borehole, activating the perforating device in the lower section below the at least one barrier, in order to create at least one perforation through the casing, wherein the perforation(s) are created adjacent a second impermeable portion of the formation;

after the perforating device has been activated:

(i) monitoring the pressure in the lower section below the at least one barrier using the pressure sensor; and, (ii) sending a wireless data signal including pressure data from below the at least one barrier to above the at least one barrier, using at least one of electromagnetic communication and acoustic communication;

wherein an upper perforating device is provided in the upper section above the at least one barrier, and wherein the method further includes creating at least one perforation between the borehole and the casing above the at least one barrier.

43. A method as claimed in claim 42, wherein the lower section below the at least one barrier defines an abandoned or suspended borehole.

* * * * *